United States Patent [19]

Onishi

[11] Patent Number: 4,747,386

[45] Date of Patent: May 31, 1988

[54] METHOD AND APPARATUS FOR AUGMENTING FUEL INJECTION ON HOT RESTART OF ENGINE

[75] Inventor: Akito Onishi, Toyota, Japan

[73] Assignee: Toyota Jidosha Kabushiki Kaisha, Japan

[21] Appl. No.: 42,425

[22] Filed: Apr. 24, 1987

[30] Foreign Application Priority Data

May 2, 1986 [JP] Japan ..... 61-100850
May 2, 1986 [JP] Japan ..... 61-100851

[51] Int. Cl.[4] ..... F02D 5/02
[52] U.S. Cl. ..... 123/491
[58] Field of Search ..... 123/491, 179 L, 179 G

[56] References Cited

U.S. PATENT DOCUMENTS

| | | | |
|---|---|---|---|
| 3,792,693 | 2/1974 | Luchaco | 123/491 |
| 4,469,072 | 9/1984 | Kobayashi | 123/491 |
| 4,522,177 | 6/1985 | Kawai et al. | 123/491 X |
| 4,594,986 | 6/1986 | Shimoda et al. | 123/491 |

FOREIGN PATENT DOCUMENTS 5824435 8/1956 Japan .

61-265334 11/1986 Japan .

*Primary Examiner*—Allen M. Ostrager
*Attorney, Agent, or Firm*—Parkhurst & Oliff

[57] ABSTRACT

The amount of fuel injection is augmented on a hot engine start by prolonging the fuel injection time or boosting the fuel pressure. For extension of the fuel injection time, a basic fuel injection time is prolonged according to a hot start fuel increment coefficient which is obtained from a two-dimentional map based on a intake air temperature stored in a memory during an engine operation (an operating intake air temperature) and the difference between the operating intake air temperature and an intake air temperature detected on restart of the engine. In case of an apparatus for augmenting the fuel injection by boosting the fuel pressure to be supplied to a fuel injector, the control pressure to be admitted into a diaphragm chamber of a pressure regulator is switched according to a two-dimentional map providing switching and unswitching conditions in terms of the difference between the operating intake air temperature and restarting intake air temperature in relation with operating intake air temperature.

4 Claims, 13 Drawing Sheets

FIG. 5

| DLTHA | | | | | |
|---|---|---|---|---|---|
| | 20 | 20 | 30 | 30 | 30 |
| | 10 | 10 | 20 | 25 | 30 |
| | 0 | 5 | 10 | 20 | 25 |
| | 0 | 0 | 5 | 10 | 20 |
| | 0 | 0 | 0 | 5 | 10 |
| 0°C | 0 | 0 | 0 | 0 | 0 |

THAE

METHOD AND APPARATUS FOR AUGMENTING FUEL INJECTION ON HOT RESTART OF ENGINE

BACKGROUND OF THE INVENTION

1. Field of the Invention

This invention relates to a method and an apparatus for augmenting the fuel injection amount at the time of hot restart of an internal combustion engine.

2. Description of the Prior Art

Normally, the fuel supply to an internal combustion engine is increased on an engine start by prolonging the valve open period of a fuel injector, thereby to ensure a good engine start. Since a colder engine requires a greater amount of fuel for starting, the fuel is supplied in an increased amount at a lower engine temperature. However, if the fuel in the vicinity of a fuel injector is in a heated state as is the case when restarting an engine immediately after a short stop, vapors occur in the fuel to be supplied by the fuel injector, so that the fuel supply becomes less than a required amount even if the fuel injector is operated to increase the fuel supply by opening its valve for longer time periods according to the engine temperature. As a consequence, an air-fuel mixture leaner than a required air-fuel ratio is supplied to the engine cylinder, making restart of the engine difficult.

Therefore, an attempt has been made to improve the engine restart quality by a control in which, at the time of a hot restart, the fuel pressure to be applied to the fuel injector is elevated for a certain time length while prolonging the fuel injection time, to compensate the air-fuel ratio in such a manner as to approach the required value. However, for enriching the air-fuel mixture on hot restarts, it has been the conventional practice to increase the amount of fuel injection when the intake air temperature exceeds a predetermined value, failing to control the fuel supply finely with sensitivity to the degree of fuel evaporation in the fuel duct.

For augmenting the fuel injection, there are two methods, namely, a method of prolonging the valve open period of the fuel injector and a method of raising the fuel pressure to be supplied to a fuel injector. The first-mentioned method, which controls the fuel injection time, corrects a basic injection period according a fuel increment coefficient at the start of an engine to prolong the valve open period of a fuel injector.

On the other hand, the method of augmenting the fuel injection on hot restart by boosting the fuel pressure to be supplied to a fuel injector utilizes a pressure regulator which controls the fuel pressure. Normally, intake manifold vacuum is led into a diaphragm chamber of the pressure regulator, controlling the fuel pressure in such a manner as to maintain a constant pressure differential between the fuel pressure and the intake manifold vacuum. On hot restart, when the cooling water temperature of the engine or the intake air temperature exceeds a predetermined value, the control pressure which is admitted into the diaphragm chamber of the pressure regulator is switched to the atmospheric pressure by means of a vacuum switching valve (VSV), thereby raising the fuel pressure for a predetermined time length on a hot restart in a degree corresponding to the pressure difference of the intake manifold vacuum to preclude overlean air-fuel ratios resulting from the fuel evaporation.

Upon lapse of a predetermined time after a hot restart, namely, at a time point when the vapors are considered to have mostly vanished from the fuel duct, the atmospheric pressure which has been admitted into the pressure regulator is switched to the intake manifold vacuum, thereby restoring the normal operating condition of the fuel pressure for the fuel injector.

As a result of researches in this regard, the present inventor has found that, when restarting an engine after a high-load operation, the necessary fuel augmentation is governed by the engine rest time (dead soak time) and the ambient temperature.

Nevertheless, according to the conventional method which increases the fuel supply by elevating the fuel pressure, the control of fuel pressure is effected when the temperature of intake air or cooling water of the engine exceeds a predetermined value, so that it is capable of only a simple control of the fuel pressure based on a present value in spite of variations in other parameters such as dedad soak time, atmospheric temperature and the like. Therefore, there often arises a situation that the pressure in the diaphragm chamber of the pressure regulator is raised to a high level when it is unnecessary or not raised to a high level when it is necessary, supplying an overrich or overlean air-fuel mixture by failure of controlling the increase of fuel supply appropriately on a restart of the engine and thus resulting in insufficient improvement of the engine starting quality.

SUMMARY OF THE INVENTION

It is therefore an object of the present invention to provide a method of augmenting fuel injection amount on hot restart of internal combustion engines, controlling the increment of fuel injection on a restart of an engine according to variations in atmospheric temperature and intake air temperature based on the length of engine rest time.

It is another object of the present invention to provide an apparatus for augmenting fuel injection amount on hot restart of internal combustion engines, improving performance quality of engines on hot restart by controlling the elevation of the fuel pressure appropriately according to variations in a parameter such as the length of engine rest time, atmospheric temperature or the like.

The present invention is based on a finding that the required increment in fuel injection on hot restart of the engine varies depending upon the length of the engine rest time (dead soak time) and the ambient temperature. FIG. 1 shows the relationship between the fuel (injector) temperature and the required fuel increment at the time of engine restart. When the fuel temperature exceeds a certain level (e.g., 60° C.), it becomes necessary to increase the fuel injection on an engine start due to generation of fuel vapors.

Besides, the injector temperature (fuel temperature) varies under the influence of the atmospheric temperature and the length of engine rest time as shown in FIG. 2. In this connection, it has been found that the intake air temperature is similarly influenced by the atmospheric temperature as shown in FIG. 3, reaching a peak substantially simulataneously with the fuel temperature shown in FIG. 2. It has also been revealed that higher the intake air temperature during engine operation, smaller becomes the increase in intake air temperature after stopping an engine as shown in FIG. 3. However, the cooling water temperature is not influenced by the atmospheric temperature during engine operation as shown in FIG. 4, largely differring from the fuel temperature and intake air temperature in the time length of reaching a peak after stopping the engine.

Therefore, according to the present invention, the fuel injection is augmented on engine start in such a manner as to establish an appropriate air-fuel ratio, by obtaining a coefficient of hot start increment FHOT from a two-dimensional map as shown in FIG. 6, which is based on the intake air temperature during engine operation THAE and the difference DLTHA between the intake air temperature during engine operation THAE (operating intake air temperature) and an intake air temperature on an engine start THA (starting intake air temperature).

More particularly, according to the present invention, there is provided a method for controlling air-fuel ratio of internal combustion engines, controlling the fuel injection time of a fuel injector by computing a basic fuel injection time of the fuel injector on the basis of the engine load and correcting the basic fuel injection time according to engine operating conditions, said method comprising: detecting the intake air temperature during operation of an engine; storing the detected operating intake air temperature in a memory means capable of keeping the stored data after stopping the engine; computing the difference between the current intake air temperature on an engine restart and the operating intake air temperature stored in the memory means; searching out a coefficient of hot start fuel increment from a two-dimensional map of hot start fuel increment coefficients FHOT based on the difference DLTHA between an intake air temperature on engine start and the operating intake air temperature and the operating air temperature THAE; increasing the fuel injection by prolonging the basic fuel injection time according to the obtained coefficient of fuel increment.

According to another embodiment of the invention, the hot start fuel increment coefficient FHOT is obtained from a two-dimensional map based on the starting intake air temperature THA and the difference DLTHA between the starting intake air temperature THA and the operating intake air temperature THAE.

In accordance with the present invention, a higher operating intake air temperature or a higher starting intake air temperature is represented by a greater hot start fuel increment coefficient FHOT to increase the fuel injection more readily even in a case where the difference DLTHA between the starting intake air temperature and the operating intake air temperature is small.

According to another aspect of the invention, there is provided an apparatus for increasing the fuel injection amount on hot restart of an internal combustion engine by raising the pressure of fuel to be supplied to a fuel injector. More particularly, as shown in the block diagram of FIG. 6, there is provided an apparatus for controlling the fuel pressure for internal combustion engine, which includes: a pressure regulator for controlling the fuel pressure in a fuel supply system of the engine; a control valve for switching the control pressure to be led to a diaphragm chamber of the pressure regulator selectively between intake manifold vacuum and atmospheric pressure; an intake air sensor means for detecting the temperature of intake air of the engine; a first memory means for storing an intake air temperature during operation of the engine continuously after stopping the engine; start sensor means for detecting a start of the engine; an arithmetic means for computing the difference between a starting intake air temperature and the operating intake air temperature stored in the first memory means; a second memory means storing information of switching and unswitching the control pressure in the form of a two-dimensional map based on the relationship of the operating intake air temperature with the difference between the starting and operating intake air temperatures; and a control means for selectively switching the control valve to admit the atmospheric pressure or intake manifold pressure into the diaphragm chamber on the basis of the results of computation by the arithmetic means upon detection of an engine start by the start sensor means and the operating intake air temperature stored in the first memory means according to the information stored in the second memory means.

The two-dimensional map of the second memory means may be a two-dimensional map which is based on the relationship between the starting intake air temperature and the difference between the starting and operating intake air temperatures.

As mentioned hereinbefore and shown in FIG. 2, the fuel temperature in the fuel supply system of engine is influenced by the atmospheric temperature and the length of engine rest time after a stop. Although the temperature of intake air of the engine exhibits a similar trend, the increase in the intake air temperature after an engine stop is smaller when the intake air temperature during engine operation is higher as shown in FIG. 3. In consideration of this fact, the pressure to be applied to the pressure regulator is controlled to a high level (1) or a normal level (0) according to a two-dimensional map based on the relationship of the operating intake air temperature THAE with the difference DLTHA between a starting intake air temperature THA and the operating intake air temperature THAE as shown in FIG. 7, switching the control pressure to be drawn to the diaphragm chamber of the pressure regulator to the high level (atmospheric pressure) to increase the fuel pressure for a necessary time period on restarting the engine, thereby ensuring satisfactory startability of the engine.

More specifically, based on the relationship of the operating intake air temperature THAE with the difference DLTHA between the starting and operating intake air temperatures THA and THAE, the information for switching or unswitching the control valve is stored in the second memory means in the form of a two-dimensional map as shown in FIG. 7. The intake air temperature THAE during engine operation is detected by the intake air sensor means, and stored in the first memory means. Upon detecting an engine start by the start sensor, the map of the second memory means is searched according to the results of arithmetic operation by the arithmetic means, that is, the difference DLTHA between the starting intake air temperature THA and the operating intake air temperature THAE and the operating intake air temperature THAE stored in the first memory means, selectively switching the control valve pursuant to the results of searching to admit the atmospheric pressure or intake manifold vacuum into the diaghragm chamber of the pressure regulator, thereby raising the fuel pressure on hot restart of the engine.

In another preferred form of the invention, the two-dimensional map stored in the second memory means contains valve switching and unswitching information based on the relationship of the starting intake air temperature THA with the difference DLTHA between the starting and operating intake air temperatures THA and THAE, giving criteria as to whether or not the fuel pressure should be elevated on an engine start.

The above and other objects, features and advantages of the invention will become more apparent from the following description and the appended claims, taken in conjunction with the accompanying drawings which show by way of example preferred embodiments of the invention.

BRIEF DESCRIPTION OF THE DRAWINGS

In the accompanying drawings:

FIG. 5 is a two-dimensional map of hot start fuel increment coefficients FHOT based on the operating intake air temperature THAE and the difference DLTHA between the starting and operating intake air temperatures;

DESCRIPTION OF THE PREFERRED EMBODIMENTS

Figure 8:
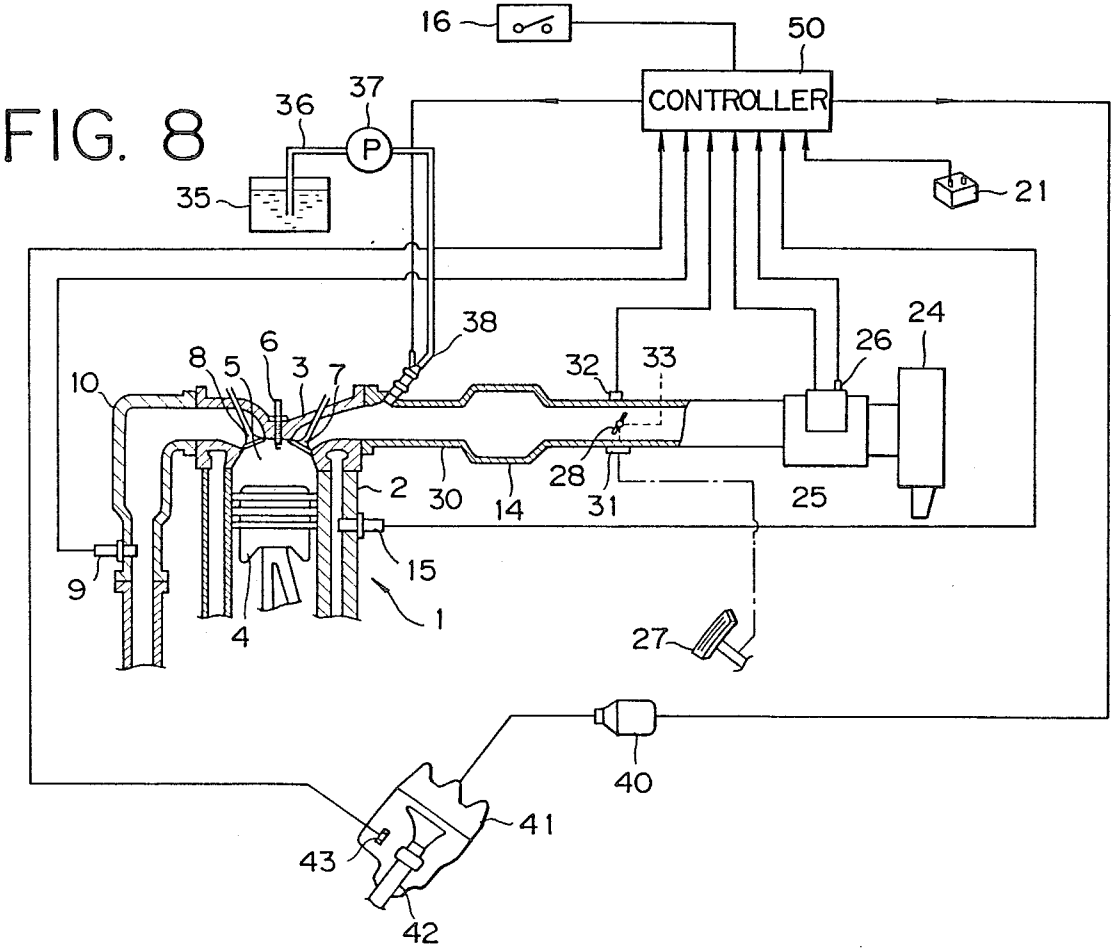
FIG. 8 is a diagrammatic illustration of an engine to which the hot restart fuel augmenting method of the invention is applicable.

Referring to FIG. 8, there is illustrated the general configuration of an internal combustion engine suitable for applying the fuel augmenting method of the invention.

In this figure, indicated at 1 is the internal combustion engine proper, at 2 a cylinder block, at 6 a spark plug, at 7 an intake valve, at 8 an exhaust valve, at 9 an oxygen sensor for detecting the oxygen concentration in exhaust gases in an exhaust manifold 10, at 15 a cooling water temperature sensor for detecting the temperature of cooling water, at 16 an ignition switch, and at 21 a power supply battery.

In the air induction system, the flow rate of intake air which is drawn in through an air cleaner 24 is measured by an air flowmeter 25, while the intake air temperature is measured by an intake air temperature sensor 26, sending a predetermined amount of intake air to an intake manifold 30 through a throttle valve 28 which is opened commensurate with the degree of depression of an accelerator pedal 27. A throttle sensor 32 is provided on a throttle body 31 to detect the degree of opening and the fully closed position of the throttle valve 28 which is mounted in the throttle body 31. Further, mounted in the vicinity of the intake valve of the intake manifold 30 is a fuel injector 38 which injects a predetermined amount of fuel which is supplied under pressure by a fuel pump 37 from a fuel tank 35 through a conduit 36.

In the ignition system, a high voltage which is generated by an igniter 40 is supplied to a distributor 41 thereby distributing the high voltage to the spark plugs 6 of the respective cylinders with a predetermined timing by the known spark timing control. A rotational speed sensor 43 is mounted on the distributor 41 to detect the rotational angle and the number of revolutions from the rotational position of a distributor shaft 42 rotating in synchronism with a crankshaft which is not shown. More particularly, the rotational speed sensor is adapted to produce 24 pulse signals in every two revolutions of the crankshaft and to produce one pulse signal at a predetermined angle in every revolution of the crankshaft.

Figure 9:
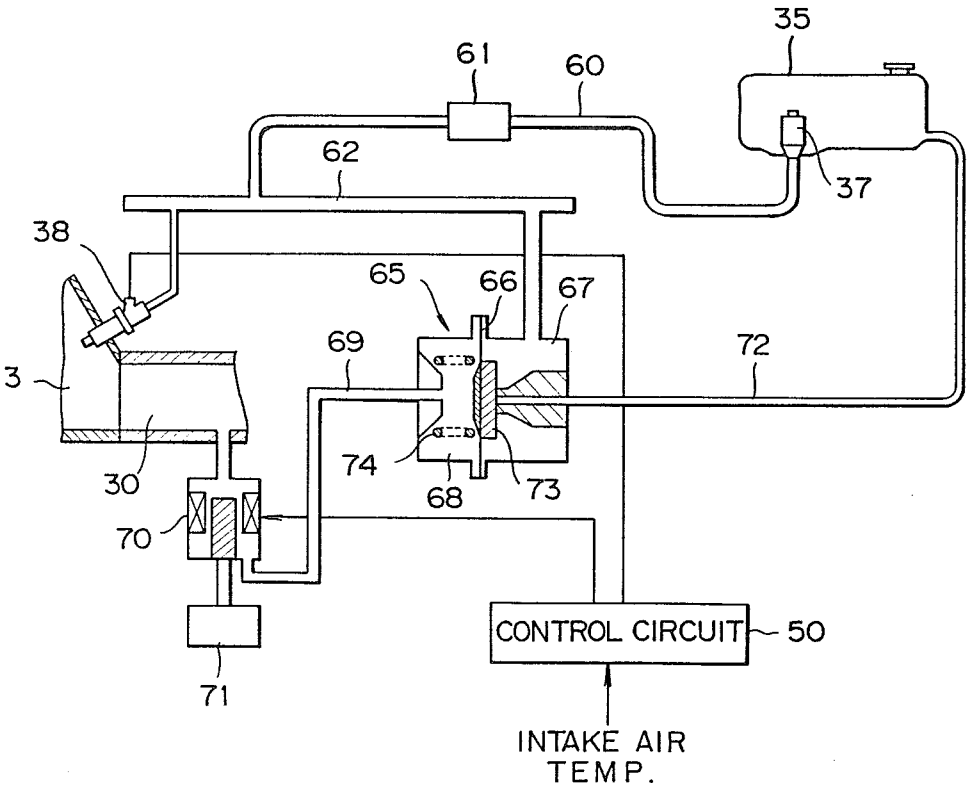
FIG. 9 is a diagrammatic illustration of a fuel supply system to which the apparatus of the invention for boosting the fuel pressure on hot restart for augmented fuel injection is applicable.

Referring to FIG. 9, there is diagrammatically shown the layout of a fuel supply system incorporating another embodiment of the invention for augmenting fuel injection by elevation of the fuel pressure. In this figure, denoted at 35 is a fuel tank, at 37 a fuel pump and at 60 a pipe which is connected to the fuel pump 37 and which has a fuel filter 61 inserted therein. The pipe 60 is connected to a delivery pipe 62 which is in communication with a fuel injector 38. Indicated at 30 is an intake manifold and at 3 a cylinder head. By driving the fuel pump 37, the fuel in the tank 35 is sent to the fuel injector 38 to inject the fuel for a certain time period according to a command from a control circuit 50 which is constituted by a microcomputer.

The system is designed such that the amount of fuel injection by the injector 38 is proportional to the time period of fuel injection, and, for this purpose, it is provided with a pressure regulator 65 for setting the pressure difference between the fuel pressure of the injector 38 and the intake manifold vacuum at a predetermined value (e.g., at 2.55 kg/cm$^2$). The pressure regulator 65 is partitioned into a fuel chamber 67 and a diaphragm chamber 68 by a diaphragm 66, the fuel chamber 67 being in communication with the delivery pipe 62. The diaphragm chamber 68 is connected to the intake manifold 30 through a pipe 69 and a vacuum switching valve 70, drawing in the intake manifold vacuum into the diaphragm chamber 68 when the vacuum switching valve 70 is off. The vacuum switching valve 70 is constituted, for example, by an electromagnetic valve, which, when energized by a signal from the control circuit 50, communicates the diaphragm chamber 68 with the atmosphere through a filter 71.

A return pipe 72 which is connected at one end to the fuel tank 35 is opened at the other end into the fuel chamber 67 of the pressure regulator 65. A valve member 73 which is attached to the diaphragm 66 and biased in the direction of closing the return pipe 72 by a spring 74 which is inserted in the diaphragm chamber 68 to act on the diaphragm 66. When the vacuum switching valve 70 is deenergized to admit the intake manifold vacuum into the diaphragm chamber 68 of the pressure regulator 65, the valve 73 is pushed up against the action of the spring 74 if the fuel pressure in the fuel chamber 67 exceeds a predetermined value, for example, 2.55 $kg/cm^2$, returning the fuel to the fuel tank 35 through the return pipe 72. When the vacuum switching valve 70 is driven in response to a command from the control circuit 50 to release the diaphragm chamber 68 to the atmosphere, the fuel is returned to the fuel tank 35 under a pressure which is higher than the fuel pressure, which is generated by admission of the intake manifold vacuum, in an extent corresponding to the intake manifold vacuum.

Figure 10:
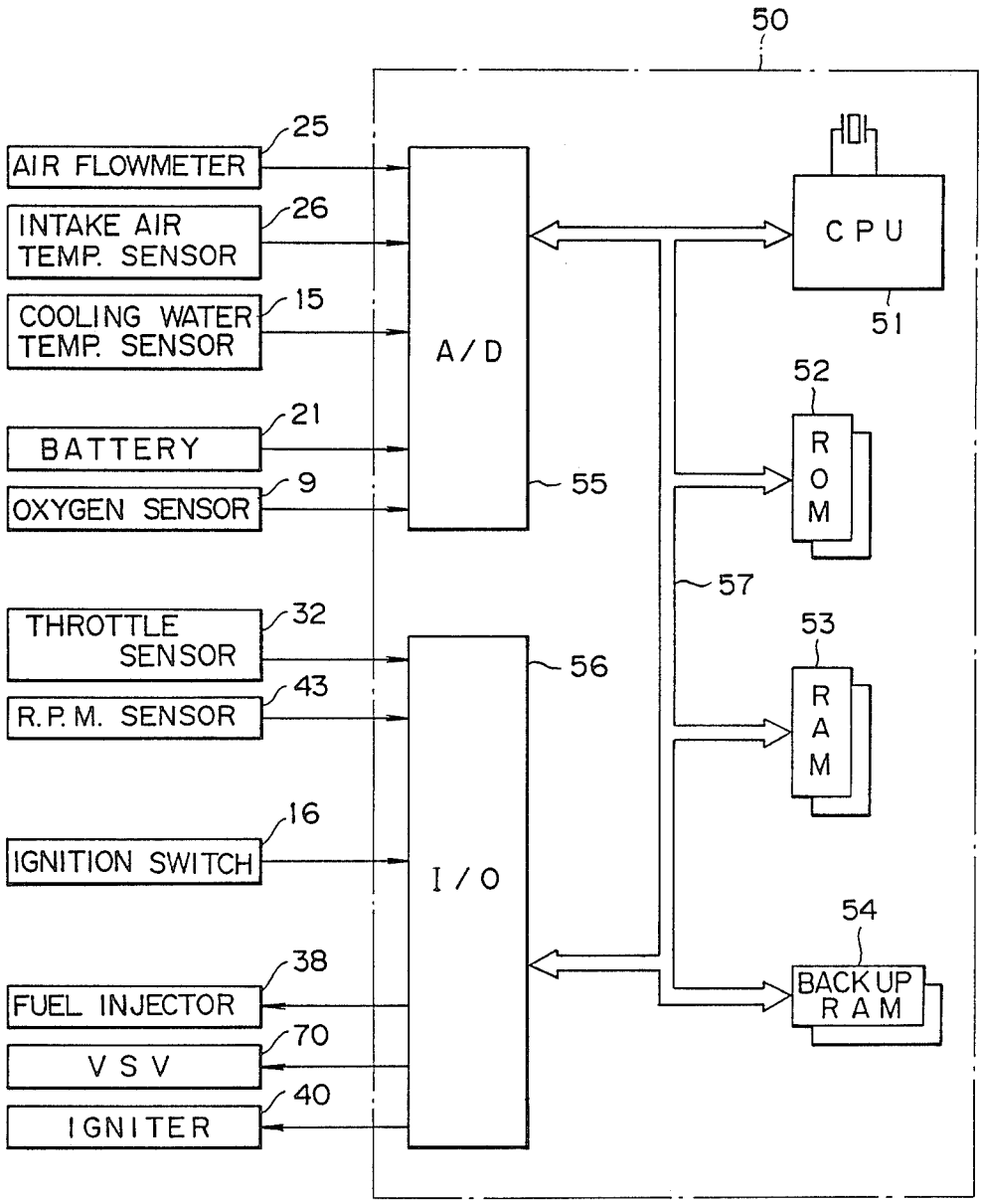
FIG. 10 is a block diagram of a control circuit which is constituted by a microcomputer.

The control unit 50 consists of a microcomputer operating on the battery 21, which includes, as shown in FIG. 10, central processing unit (CPU) 51, read-only-memory (ROM) 52, random access memory (RAM) 53, and backup random access memory (RAM) 54 capable of retaining stored data after the ignition switch 16 is turned off. Stored in ROM 52 are programs such as main routine, fuel injection control routine, spark timing control routine and the like, as well as various fixed data and constants required in these routines. The microcomputer incorporates therein an A/D converter 55 with a multiplexer and an I/O device 56 with buffer memory. The A/D converter 55 and I/O device 56 are interconnected with the afore-mentioned components 51 to 56 through a common bus 57.

At the A/D converter 55, the output signals of the respective sensors including the air flowmeter 25 and intake air temperature sensor 26 are sent to the multiplexer through the buffer, and, after A/D conversion, these data are sent to CPU 51 and RAM 53 or 54 at predetermined time points in response to commands from CPU 51. By so doing, RAM 53 or 54 is supplied with fresh data of the intake air amount, intake air temperature, cooling water temperature etc. to store them in predetermined areas. The output signals of the throttle sensor 32 and rotational speed sensor 43 are sent to I/O device 56, supplying these data to CPU 51 and RAM 53 or 54 at predetermined time points in response to commands from CPU 51.

CPU 51 computes the amount of fuel injection according to the programs stored in ROM 52 on the basis of the data detected by the respective sensors, sending an output pulse signal to the fuel injector 38 through I/O device 56. More particularly, fundamentally a basic amount of fuel (a basic fuel injection time) is computed from the intake air flow rate detected by the air flowmeter 25 and the engine r.p.m. detected by the rotational speed sensor 43, and then the computed amount is corrected according to the detected intake air and cooling water temperatures, sending the injector 38 a pulse signal corresponding to the corrected amount of fuel through a drive circuit, not shown, of the I/O device 56.

Figure 11:
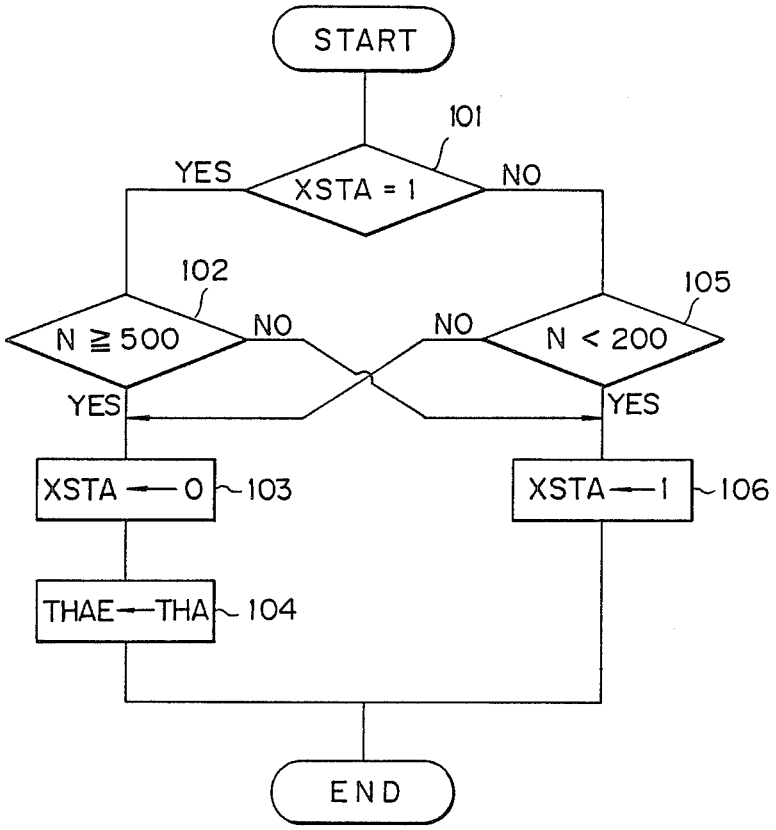
Figure 12:
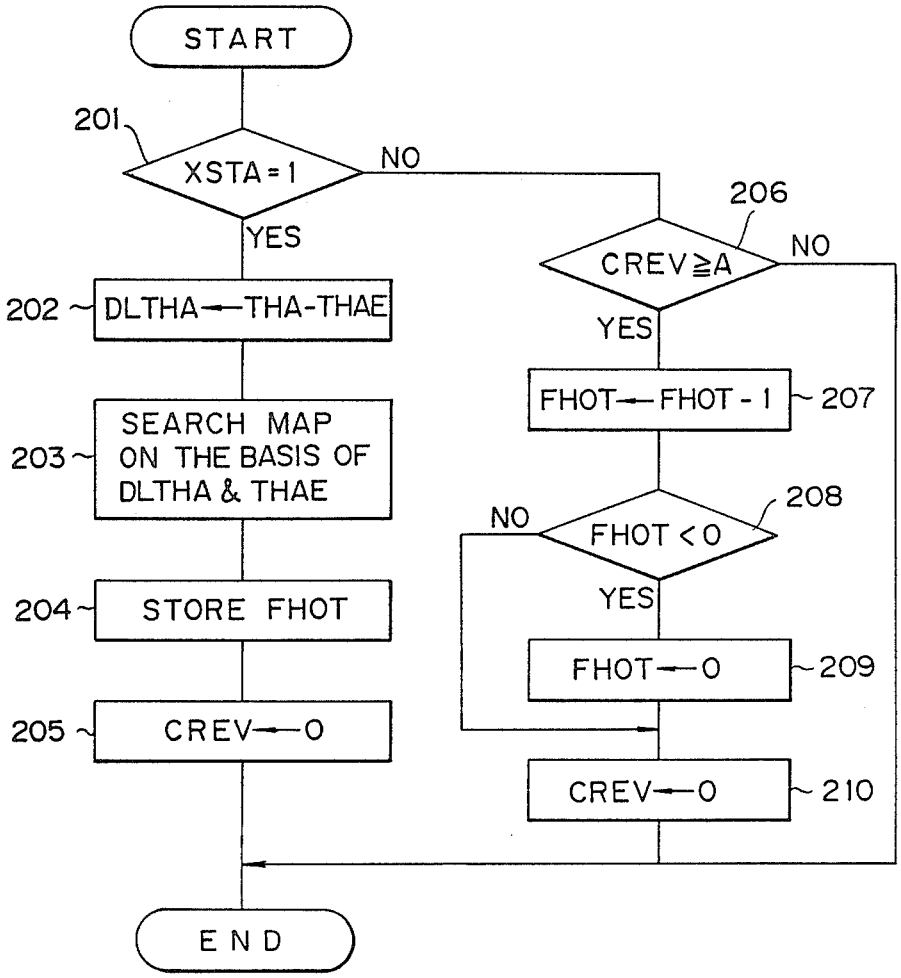
FIGS. 12 to 13 are flowcharts of processing routines in an embodiment of the fuel augmenting method of the invention.
Figure 13:
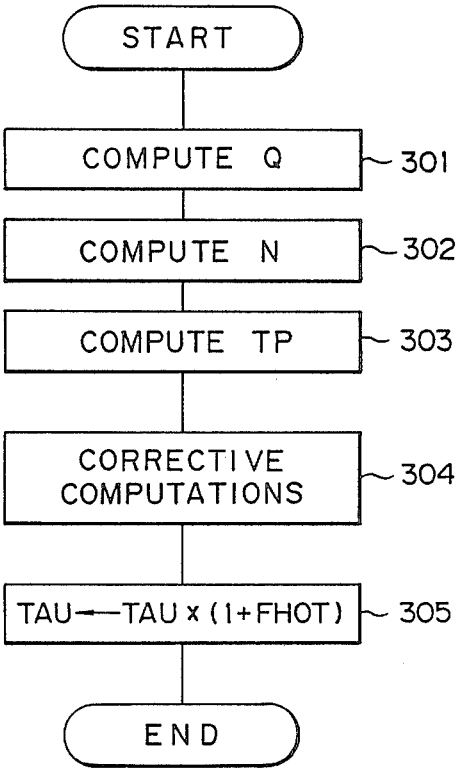

Now, an embodiment of the method of the invention is described with reference to the flowcharts of FIGS. 11 to 13 showing an operation for increasing fuel injection on a hot restart of an internal combustion engine.

The processing routines of FIGS. 11 to 13 are executed as part of a main routine.

Firstly, the state of the engine, namely, whether or not the engine is at a start is checked in the processing routine of FIG. 11. More specifically, in Step 101, it is checked whether or not a flag XSTA which is set upon turning on the ignition switch is set. If the flag XSTA is found to be set in Step 101, the processing goes to Step 102 to see if the engine speed is higher than 500 r.p.m. If higher than 500 r.p.m., it is considered that the engine is already out of a starting state, and the flag XSTA is reset in Step 103. Nextly, the processing goes to Step 104 to store an intake air temperature THA of the engine of a non-starting state in backup RAM 54 as THAE.

On the other hand, if the engine speed N is found to be lower than 500 r.p.m. in Step 102, it is considered that the engine is in a starting state, setting the flag XSTA in Step 106. If the Flag XSTA is found to be reset in Step 101, the processing goes to Step 105 to check whether or not the engine speed N is lower than a predetermined value, for example, 200 r.p.m. If the engine speed N is lower than 200 r.p.m., it is considered that the engine is in a starting state, and the processing goes to Step 106 to set the flag XSTA. If higher than 200 r.p.m., the processing goes to Step 103 to reset the flag XSTA.

In this manner, the routine of FIG. 11 checks whether or not the engine is in a starting state, and, if the engine is found to be in operation in non-starting state, THAE in the backup RAM 54 is each time renewed with the current intake air temperature THA.

Reference now had to the flowchart of FIG. 12 to explain a processing routine for determining a hot start fuel increment coefficient FHOT from THAE thus obtained, and attenuating FHOT after the engine start at each predetermined number of revolutions. Firstly, a check is made in Step 201 as to whether or not the engine is currently in the starting state, namely, wheteher or not the flag XSTA is set. If the flag is found to be set, the routine for determining the hot start fuel increment coefficient FHOT is executed. In Step 202, it is computed the difference DLTHA between the previous intake air temperature THAE of the engine operating in a non-starting state, stored in backup RAM 54, and the current intake air temperature THA of the engine in a starting state. In next Step 203, based on THAE and DLTHA, the currently required hot start fuel increment coefficient FHOT is searched out from a two-dimensional map of hot start fuel increment coefficient FHOT which is stored in ROM 52 and consists of THAE and DLTHA as shown in FIG. 5. Then, the processing goes to Step 204 to store the hot start fuel increment coefficient FHOT in RAM 53, and thence to Step 205 to clear a counter CREV which ups its count at each revolution of the engine.

On the other hand, if the current state of the engine is found to be not in a starting state in Step 201, the processing executes steps for attenuating the hot start fuel increment coefficient FHOT gradually at every predetermined number of engine revolutions until it becomes zero. Firstly, whether or not the counter CREV has exceeded a predetermined transitional number of revolutions A (e.g., 50 revolutions) is checked in Step 206. If negative, it is considered to be not in the attenuating timing. If the counter CREV is found to be greater than A in Step 206, it is considered to be in the attenuating timing, advancing the processing to Step 207 to decrement the hot start fuel increment coefficient FHOT. In the next Step 208, whether or not the hot start fuel increment coefficient FHOT is negative is checked. If negative, the processing goes to Step 209 to clear the hot start fuel increment coefficient FHOT. If the hot start fuel increment coefficient FHOT is found to be positive in Step 208 and in the case of negative, after clearing FHOT in Step 209, the processing goes to Step 210 to clear the counter CREV in preparation for the next attenuating timing. Namely, the FHOT attenuating process in Steps 206 to 210 is performed at every predetermined number of revolutions A after an engine start to attenuate the hot start fuel increment coefficient FHOT gradually until it becomes zero. Although illustration of the counter CREV is omitted in the drawings, its increment is effected by a processing routine which is actuated on each revolution of the engine.

Reference is now had to FIG. 13 for the explanation of the processing routine for determining the fuel injection time TAU according to the hot start fuel increment coefficient FHOT thus obtained. Firstly, the intake air flow rate Q is determined from the output signal of the air flowmeter 25 in Step 301, and the engine speed N is determined from the r.p.m. sensor 43 in Step 302, computing a basic fuel injection time TP in Step 303 according to Q and N thus obtained. Nextly, correction coefficients are determined in Step 304 on the basis of the engine cooling water temperature and intake air temperature etc., determining a fuel injection time TAU by correcting the basic fuel injection time TP with the correction coefficients. In the next Step 305, TAU is multiplied by the hot start fuel increment coefficient FHOT which is obtained by the processing routine of FIG. 12, to give a final fuel injection time TAU.

In the above-described embodiment, the two-demensional map of hot start fuel increment coefficient FHOT stored in ROM 52 is based on the operating intake air temperature THAE and the difference DLTAE between the starting intake air temperature THA and the operating intake air temperature THAE. However, the present invention is not limited to such a two-dimensional map of the hot start fuel increment coefficient FHOT, and can similarly use a two-dimensional map of the hot start fuel increment coefficient FHOT which is based on the starting intake air temperature THA and the difference between the operating and starting intake air temperatures THAE and THA.

Figure 14:
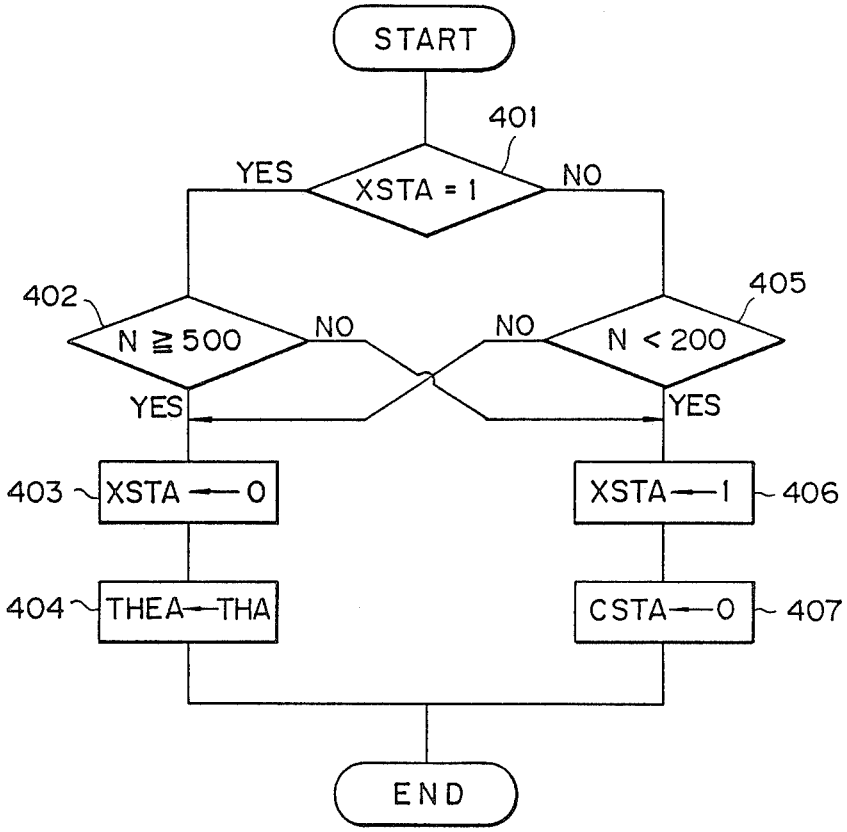
FIGS. 14 and 15 are flowcharts showing the operation of an embodiment of the apparatus for augmenting the fuel injection by elevation of the fuel pressure.
Figure 15:
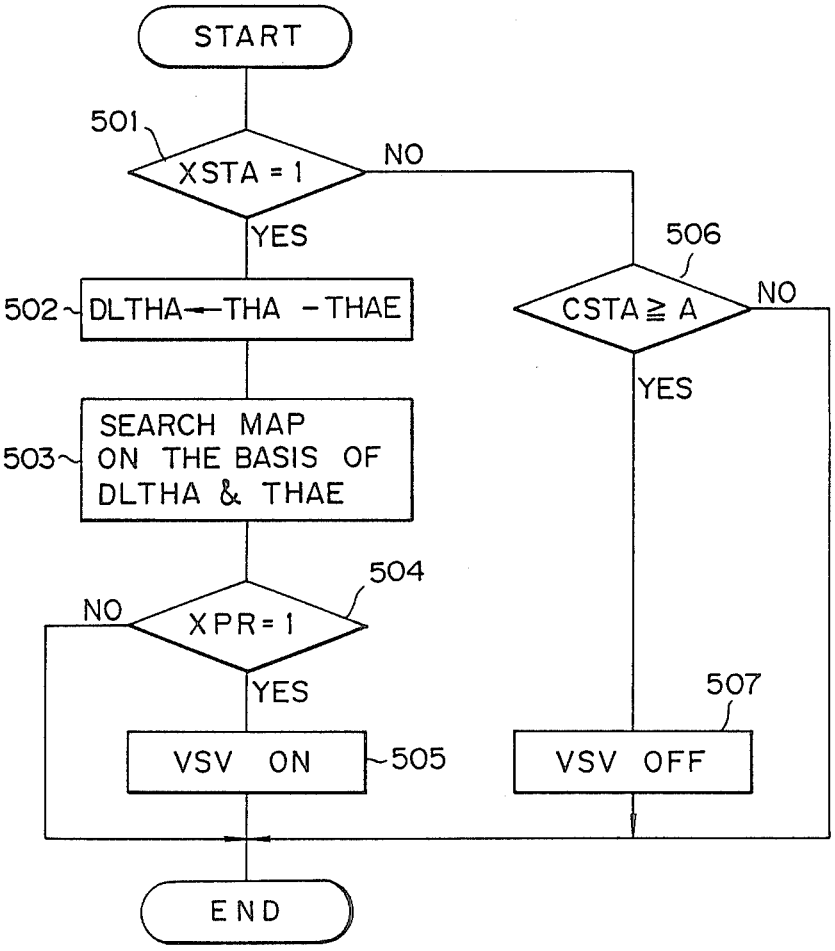

Reference is now had to the flowcharts of FIGS. 14 and 15 for the explanation of an embodiment of the apparatus of the invention which augments the fuel injection by elevating the fuel pressure.

The flowcharts of FIGS. 14 and 15 show the operations of the embodiment of the apparatus for augmenting the fuel injection by elevating the fuel pressure according to the invention, which constitute a part of a main routine. Referring to the flowchart of FIG. 14, the engine state is checked in Step 401 to see whether or not it is in a starting state, namely, whether or not the flag XSTA is set. If the flag XSTA is set, the processing goes to Step 402 to check whether or not the engine speed N is higher than 500 r.p.m. If affirmative, the engine is considered to be already out of the starting state, and the processing goes to Step 403 to reset the flag XSTA. In next Step 404, the operating intake air temperature THA is stored in RAM 56 as THAE. More particularly, in this step, the value of THAE stored in RAM 53 is renewed with the current intake air temperature THA which is detected by the intake air temperature sensor 26.

If the engine speed is detected to be lower than 500 r.p.m. in Step 402, the engine is considered to be still in a starting state, and the flag XSTA is set in Step 406, followed by Step 407 to clear the start-on counter CSTA which operates on a predetemined incremental time period.

On the other hand, if the engine is found to be not in a starting state in Step 401, the processing goes to Step 405 to check whether or not the engine speed N is lower than 200 r.p.m. If the engine speed is greater than 200 r.p.m., the processing goes to Step 403 to reset XSTA, followed by execution of Step 404. If the engine speed is found to be lower than 200 r.p.m. in Step 405, it is considered to be in a starting state, followed by Step 406 to set the flag XSTA and then by Step 407 to clear the start-on counter CSTA.

Reference is now had to the flowchart of FIG. 15 for the explanation of a routine for controlling on-off of the atmospheric pressure to be drawn into the diaphragm chamber 68 of the pressure regulator 65 as a control pressure, on the basis of the operating intake air temperature THAE stored in RAM 53 and the starting intake air temperature THA detected by the intake air temperature sensor 26.

Figure 1:
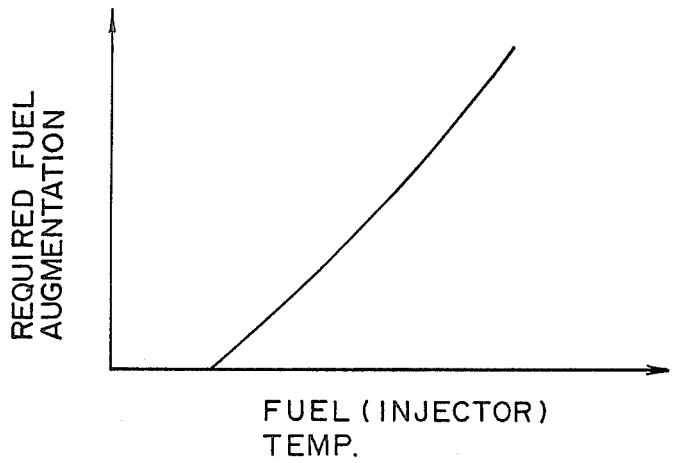
FIG. 1 is a graph plotting variations in the value of required fuel increment against the fuel temperature (injector temperature)
Figure 2:
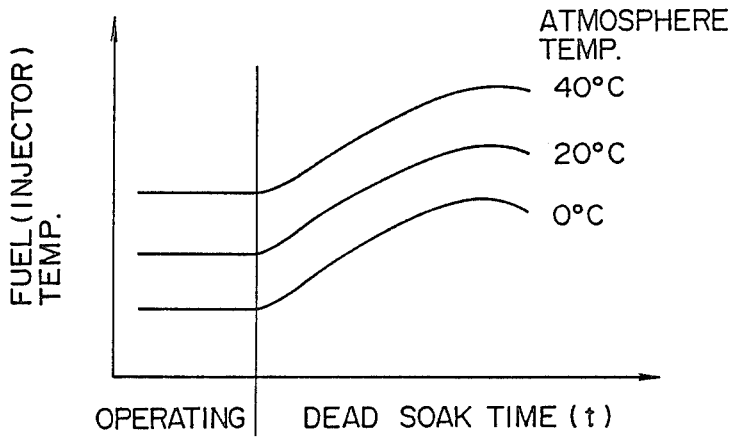
FIG. 2 is a graph showing the influences of the atmospheric temperature and engine rest time on the fuel temperature (injectore temperature)
Figure 3:
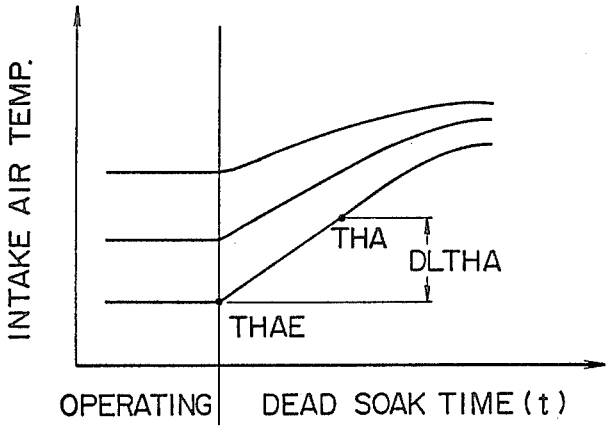
FIG. 3 is a graph showing the influences of the atmospheric temperature and engine rest time on the intake air temperature after stopping the engine.
Figure 4:
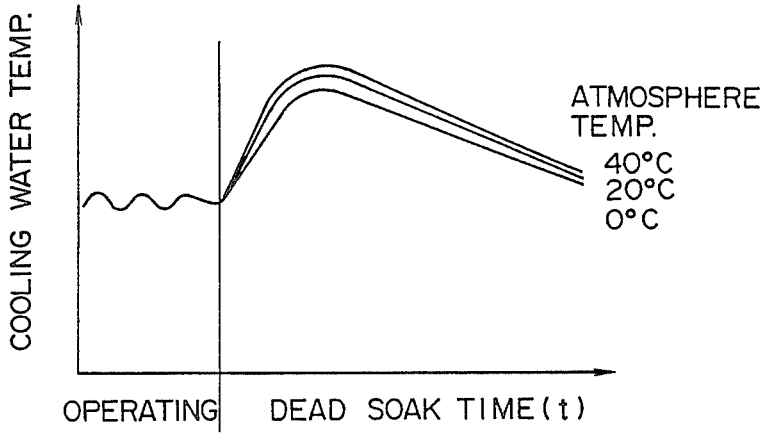
FIG. 4 is a graph plotting cooling water temperatures before and after stopping the engine.
Figure 6:
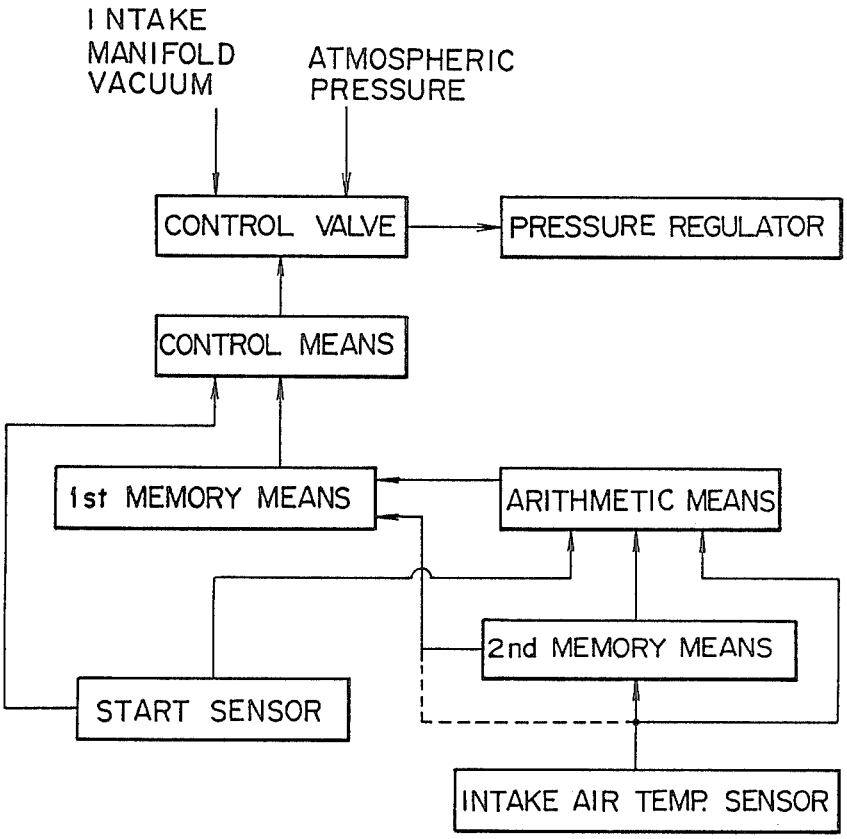
FIG. 6 is a block diagram showing the layout of a fuel augmenting apparatus by raising the fuel pressure according to the present invention.
Figure 7:
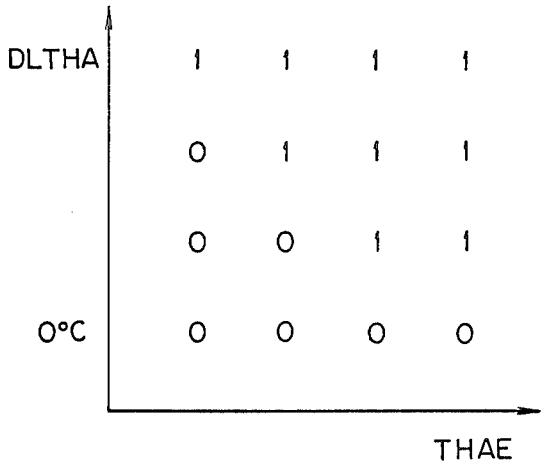
FIG. 7 is a two-dimensional map providing conditions for raising the fuel pressure, on the basis of the difference DLTHA between the starting and operating intake air temperatures and the operating intake air temperature THAE.

The current state of the engine is firstly checked in Step 501 to ascertian whether or not it is in a starting state, namely, whether or not the flag XSTA which represents the starting state is set. If the flag XSTA is set, the processing goes to Step 502 to compute the differnce DLTHA between the current intake air temperature THA detected by the sensor 26 and the operating intake air temperature THAE stored in RAM 53. In next Step 503, a two-dimensional map as shown in FIG. 7, which is stored in ROM 52, is searched on the basis of the value of DLTHA thus obtained and the operating intake air temperature THAE stored in RAM 53.

In Step 504, the results of searching are judged by way of a high pressure flag XPR. If the flag is set, the processing goes to Step 505 to turn on the vacuum switching valve (VSV), admitting the atmospheric pressure into the diaphragm chamber of the pressure regulator 65 to execute the hot start fuel pressure control thereby boosting the fuel pressure to prevent overleaning of the air-fuel ratio as caused by fuel vapors. If the high pressure flag XPR is not set in Step 504, it means that the engine is not in the condition for the hot start fuel pressure control, so that this routine is ended without any further execution.

On the other hand, when the flag XSTA is found to be reset in Step 501, indicating that the engine is not in a starting state, the processing goes to Step 506 to judge whether or not the count of the start-on counter CSTA is greater than a predetermined value A (e.g., 100 sec.). If greater than A, it is considered to be a timing for switching the control pressure to be admitted into the diaphragm chamber 68 of the pressure regulator 65 to the intake manifold vacuum, turning off the vacuum switching valve (VSV) 70 in Step 507 to resume the operation of introducing the intake manifold vacuum into the diaphragm chamber 68 of the pressure regulator 65, thereby controlling the fuel pressure to be applied to the fuel injector in response to and in such a manner as to maintain a constant pressure differential from the intake manifold vacuum. When the count of the start-on counter CSTA is smaller than the predetermined value A, this routine is ended without turning off the vacuum switching valve 70. As a result, the fuel boosting is relieved upon lapse of a predetermined time period (e.g., 100 sec.) from an engine start. Although omitted in the drawing, the start-on counter CSTA is arranged in a routine which is activated at predetermined time intervals, each time adding an increment to the counter.

In the foregoing embodiments, the on-off of the vacuum switching valve 70 is controlled according to a two-dimensional map of DLTHA and THAE. However, it is to be understood that the present invention is not restricted to the particular map arrangement shown, and that a similar control is possible by the use of a two-dimensional map of DLTHA and the starting intake air temperature THA.

As clear from the foregoing description, the present invention controls the fuel augmentation on hot restart of an engine according to the intake air temperature varying depending upon the engine reset time (dead soak time) and the ambient temperature, so that the fuel injection is augmented to a necessary degree according to the condition of the engine by prolonging the fuel injection time or by boosting the fuel pressure to establish an appropriate air-fuel ratio on hot restart of the engine.

What is claimed is:

1. A method for controlling air-fuel ratio of internal combustion engine by calculating the length of a basic fuel injection time on the basis of engine load, and controlling the fuel injection time of a fuel injector by correcting the basic fuel injection time according to the operating condition of the engine, said method comprising the steps of:

detecting the intake air temperature during operation of said engine;

storing the detected air temperature in a memory means capable of saving the stored data after stopping said engine;

computing on starting said engine the difference between the current intake air temperature of the engine in a starting state and the operating intake air temperature stored in said memory means;

searching out a hot start fuel increment coefficient from a two-dimensional map of fuel increment coefficients based on the operating intake air temperature and the difference between the starting and operating intake air temperatures; and controlling the amount of fuel injection by increasing said basic fuel injection time according to said fuel increment coefficient.

2. A method for controlling air-fuel ratio of internal combustion engine by calculating the length of a basic fuel injection time on the basis of engine load, and controlling the fuel injection time of a fuel injector by correcting the basic fuel injection time according to the operating condition of the engine, said method comprising the steps of:

detecting the intake air temperature during operation of said engine;

storing the detected air temperature in a memory means capable of saving the stored data after stopping said engine;

computing on starting said engine the difference between the current intake air temperature of the engine in a starting state and the operating intake air temperature stored in said memory means;

searching out a hot start fuel increment coefficient from a two-dimensional map of fuel increment coefficients based on the starting intake air temperature and the difference between the starting and operating intake air temperatures; and controlling the amount of fuel injection by increasing said basic fuel injection time according to said fuel increment coefficient.

3. An apparatus for augmenting the amount of fuel injection of internal combustion engine, comprising:

a pressure regulator for controlling the fuel pressure of a fuel supply system of an internal combustion engine;

a control valve for selectively switching the control pressure to be drawn into a diaphragm chamber of said pressure regulator between intake manifold vacuum and atmospheric pressure;

an intake air temperature sensor means for detecting the intake air temperature of said engine;

a first memory means for storing the intake air temperature detected by said intake air temperature sensor means, continuously after stopping said engine;

a start sensor means for detecting a start of said engine;

an arithmetic means for computing the difference between the intake air temperature on an engine start and the operating intake air temperature stored in said first memory means;

a second memory means for storing a two-dimensional map providing information as to the condition for switching said control valve according to the relationship of the difference between said starting and operating intake air temperatures with said operating intake air temperature; and a control means adapted to admit either the atmospheric pressure or intake manifold vacuum selectively into said diaphragm chamber upon detection of an engine start by said start sensor means on the basis of the results of computation by said arithmetic means and the operating intake air temperature stored in said first memory means in reference to the information stored in said second memory means.

4. An apparatus for augmenting the amount of fuel injection of internal combustion engine, comprising:

a pressure regulator for controlling the fuel pressure of a fuel supply system of an internal combustion engine;

a control valve for selectively switching the control pressure to be drawn into a diaphragm chamber of said pressure regulator between intake manifold vacuum and atmospheric pressure;

an intake air temperature sensor means for detecting the intake air temperature of said engine;

a first memory means for storing the intake air temperature detected by said intake air temperature sensor means, continuously after stopping said engine;

a start sensor means for detecting a start of said engine;

an arithmetic means for computing the difference between the intake air temperature on an engine start and the operating intake air temperature stored in said first memory means;

a second memory means for storing a two-dimensional map providing information as to the condition for switching said control valve according to the relationship of the difference between said starting and operating intake air temperatures with said starting intake air temperature; and a control means adapted to admit either the atmospheric pressure or intake manifold vacuum selectively into said diaphragm chamber upon detection of an engine start by said start sensor means on the basis of the result of computation by said arithmetic means and the starting intake air temperature detected by said intake air temperature sensor means in reference to the information stored in said second memory means.

* * * * *